United States Patent [19]

Lucas

[11] Patent Number: 5,026,193

[45] Date of Patent: Jun. 25, 1991

[54] DISTRIBUTOR AND APPLICATOR DEVICE WITH A MANUAL CLOSING MEMBER

[76] Inventor: Marthe Lucas, 22 allée des Fauvettes, 34280 La Grande Motte, Hérault, France

[21] Appl. No.: 450,986

[22] Filed: Dec. 15, 1989

[30] Foreign Application Priority Data

Dec. 15, 1988 [FR] France ..... 88 16563

[51] Int. Cl.[5] ..... A45D 34/04

[52] U.S. Cl. ..... 401/219; 222/525; 401/205; 401/208; 401/269; 401/277; 401/280

[58] Field of Search ..... 401/269, 277, 280, 208, 401/205, 219; 222/525, 562

[56] References Cited

U.S. PATENT DOCUMENTS

| | | | |
|---|---|---|---|
| 4,020,981 | 5/1977 | Nixdorff | 222/525 |
| 4,150,904 | 4/1979 | Stewart | 401/208 X |
| 4,739,906 | 4/1988 | Loturco | 222/562 X |
| 4,909,265 | 3/1990 | Goncalves | 401/219 X |

FOREIGN PATENT DOCUMENTS

| | | | |
|---|---|---|---|
| 0247885 | 12/1987 | European Pat. Off. | 401/277 |

*Primary Examiner*—Steven A. Bratlie

*Attorney, Agent, or Firm*—Browdy and Neimark

[57] ABSTRACT

The distributor and applicator device comprises a manual closing member including a plug (3) connected to the neck (2) of a container (1) and provided with a closing finger (9) leaving flowing apertures (8) free and controlling passage of a ring (14) leading to a distributor part (16) of a product contained in the container (1) and directed to an applicator member (24). A socket (10) is placed around the neck (2) and is mobile axially. The socket (10) includes a ring (14) for cooperating with the closing finger (9) and at least one knob (17) protruding through at least one aperture (18) of the distributor part (16) fixed to the container (1). The knob is axially guided by the at least one aperture (18) in which it slides for axially displacing the socket (10).

10 Claims, 1 Drawing Sheet

DISTRIBUTOR AND APPLICATOR DEVICE WITH A MANUAL CLOSING MEMBER

FIELD AND BACKGROUND OF THE INVENTION

The present invention relates to a new distributor and applicator device for opening and closing a container, such a device being operated by a simple axial pressure exerted on one or several knobs protruding from the device.

The part forming the distributor of the device of the invention may be absolutely of any type.

The device of the invention provides also for the sealing of a container whatever the position of its closing member. Actually the content of a flask on which the device is mounted can flow out only when this flow is authorized.

Due to its constitution, the device of the invention can be made simply with a small number of parts which can be manufactured by injection moulding of plastics material.

SUMMARY OF THE INVENTION

According to the invention, the distributor part and applicator device with a manual closing member including a plug connected to neck of a container and provided with a closing finger leaving flowing apertures free and controlling passage of a ring leading to a distributor of a product contained in the container and directed to an applicator member, is characterized by a socket placed around the neck and mobile axially, this socket including a ring for cooperating with the closing finger and at least one knob protruding through at least one aperture of the distributor part fixed to the container, this knob being axially guided by the at least one aperture in which it slides for axially displacing the socket.

Various other features of the invention will become more apparent from the following detailed description.

BRIEF DESCRIPTION OF THE DRAWINGS

An embodiment of the invention is shown, by way of a non limiting example, in the accompanying drawings wherein.

DETAILED DESCRIPTION OF A PREFERRED EMBODIMENT OF THE INVENTION

Figure 1:
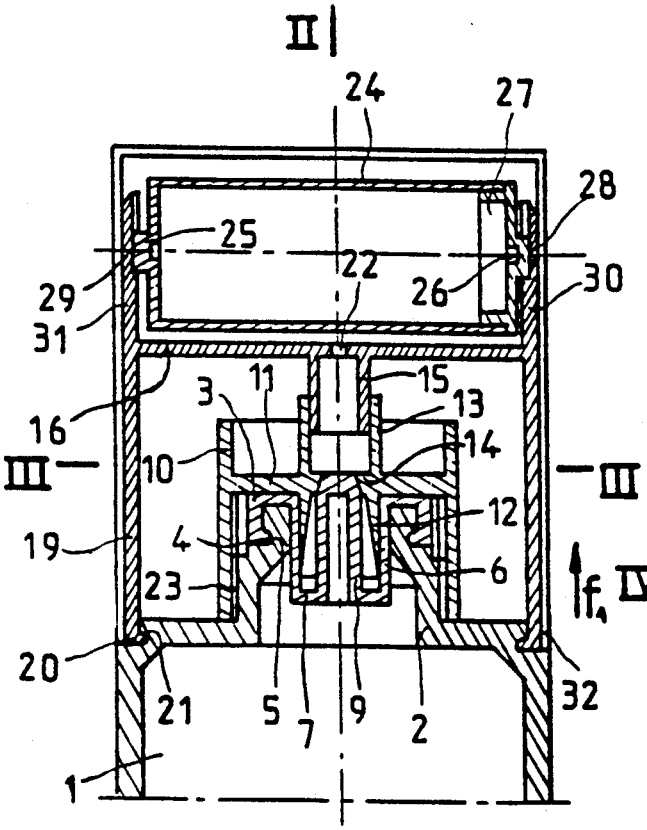
FIG. 1 is a longitudinal cross-sectional elevation view of the device of the invention.

The drawings show in a schematic way a container 1, for example a flask having a neck 2.

The shape in cross-section of the container 1 may be absolutely of any type. The drawings show that this shape may be, for example, substantially ovoidal the smaller sides being flat and the greater sides arcuate.

The top of the neck 2 supports a plug 3 covering the neck 2 and advantageously fixed by a retaining keeper 4 entering a groove 5 of the neck 2.

Figure 2:
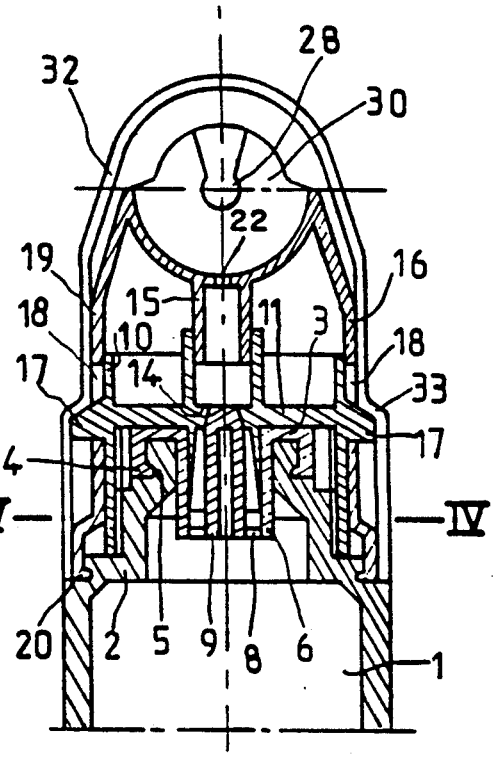
FIG. 2 is a transverse cross-sectional view taken along line II—II of FIG. 1.

The plug 3 defines inside the neck 2 a cylindrical socket 6 having a base 7 (FIG. 1) which is formed with apertures 8 (FIG. 2). The base 7 supports a closing finger 9 having a frustoconical end.

A socket 10 is slidably engaged on the neck 2 and has a transverse wall 11 from which protrude: a lower sealing skirt 12, an upper sealing skirt 13 and a ring 14 with a frustoconical inner wall for bearing on the frustoconical end of the closing finger 9.

The lower sealing skirt 12 is applied against the inner wall of the socket 6 while the upper sealing skirt 13 bears against the wall of a sleeve 15 extended by a distributor part generally designated by reference numeral 16.

Figure 3:
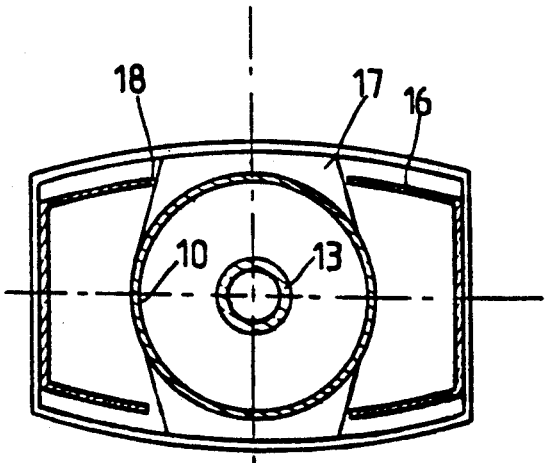
FIG. 3 is a cross-sectional view taken substantially along line III—III of FIG. 2.
Figure 4:
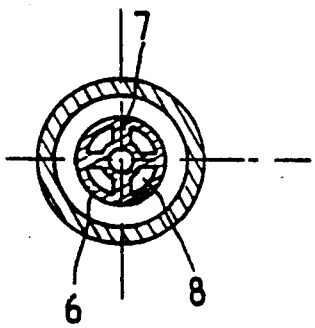
FIG. 4 is a partial cross-sectional view taken substantially along line IV—IV of FIG. 2.

The socket 10 forms in addition at least one actuating knob 17, and preferably two actuating knobs as, shown in FIGS. 2 and 3. The knob or knobs 17 are provided to protrude through one or several apertures 18 formed in the side wall 19 of the distributor part 16.

The side wall 19 of the distributor part 16 is fixed by any convenient means to the container 1, for example by means of a retaining keeper 20 entering a groove 21. The distributor part 16 includes at least one distribution hole 22 formed inside the sleeve 15.

As shown in the above disclosure, the distributor part 16 is fixed with respect to the container 1 and the same applies to the plug 3. On the contrary, the socket 10 can slide along the neck 2 so that the ring 14 will act as a closing element in cooperation with the closing finger 9.

If desired and for preventing the socket 10 from rotating with respect to the neck 2, cooperating rib and groove means 23 may be formed between the socket 10 and the neck 2. It is also possible to prevent a rotation of the socket 10 simply by guiding the socket 10 via its knob or knobs 17 inside the aperture or apertures 18 of the distributor 16.

The distributor part 16 may comprise one or several applicator members, each formed for example of a cylinder 24 having pins 25, 26 one of which, in the present case the pin 26, being formed by a plug 27 engaged inside the cylinder 24. This embodiment in two parts facilitates a simple manufacture by injection moulding of plastics material or the like.

The pins 25, 26 are engaged via a resilient deformation in depressions 28, 29 of flanges 30, 31 formed by the distributor part 16 which, in the same manner as the other hereabove described parts, may be made in a simple manner by injection moulding of plastics material.

The cylinder 24 may be replaced, in a manner known in the art, by any other applicator of same kind such as balls, rings, etc., top of the distributor part 16 being then of course conformed in an appropriate manner.

When the various parts are in the position shown in the drawings, the ring 14 will bear on the frustoconical portion of the closing finger 9 and, consequently, the container 1 is closed and the product contained therein cannot flow toward the hole 22 via the apertures 8 and the annular channel separating the socket 6 from the outer wall of the closing finger 9.

By acting on one at least of the knobs 17 in order to displace it in direction of the arrow $f_1$ (FIG. 2), the socket 10 is lifted as well as the ring 14. Consequently, the product contained in the container can now flow toward the hole 22, the tightness being however permanently ensured by the lower sealing skirt 12 and the upper sealing skirt 13 which are displaced together with the socket 10.

In addition to the preceding disclosure, the device will advantageously comprise a cover 32 conformed so as to have at least one shoulder 33 corresponding to the knobs 17. In this manner, when the cover 32 is put in position, it displaces automatically the knobs 17 in the direction contrary to the arrow $f_1$, the effect of which is to provide for an automatic closing of the device even if this closing has been inadvertently forgotten prior to putting the cover 32 in position.

The invention is not limited to the embodiments shown and described in detail and various modifications can be carried out thereto without departing from its scope. In particular, the distributor part 16 can comprise no applicator members of the cylindrical type, but be only conformed so that its upper surface forms by itself an applicator, or in a manner that it provides simply for a distribution via the distributor hole 22, or an end-piece or a nozzle placed in the distribution hole 22. Likewise, the outer wall of the plug 3 can be used directly as a guide for the socket 10, thereby avoiding to have to provide a particular conformation for the outer wall of the neck 2. In a simplified alternative, the socket 10 can be reduced in height in order to form only the knobs 17, guiding of the socket 10 being performed by the lower skirt 12 and the upper skirt 13.

I claim:

1. A distributor and applicator device with a manual closing member including a plug connected to neck of a container and provided with a closing finger leaving flowing apertures free and controlling passage of a ring leading to a distributor part of a product contained in the container and directed to an applicator member, wherein a socket is placed around the neck and is mobile axially, said socket including a ring for cooperating with said closing finger and at least one actuation knob protruding through at least one aperture of said distributor part fixed to the container, said knob being axially guided by the at least one aperture in which it slides for axially displacing said socket.

2. The device as set forth in claim 1, wherein said socket includes a median partition wall from which protrude: a lower sealing skirt entering said socket and an upper sealing skirt cooperating with a sleeve which is part of the distributor part for ensuring a flow of a product contained in a container toward a distribution hole when the device is opened by an axial displacement of the socket.

3. The device as set forth in claim 1, wherein said plug supporting the closing finger is fixed to the neck by a retaining element.

4. The device as set forth in claim 1, wherein said socket is axially guided by rib and groove means formed thereon as well as the container.

5. The device as set forth in claim 1, wherein said distributor part is fixed to said container by a retaining element and is formed with at least one aperture through which protrudes at least one knob for actuation of the socket.

6. The device as set forth in claim 1, wherein the socket is axially guided by two knobs extending through at least one aperture.

7. The device as set forth in claim 1, wherein the applicator member is made of a cylinder closed by a plug, said cylinder as well as the plug having a set of pins provided in alignment and engaged in a set of depressions of flanges formed from said distributor.

8. The device as set forth in claim 1, further including a cover.

9. The device as set forth in claim 8, wherein said cover defines at least one shoulder provided to bear on the at least one actuation knob and to bring it into a position for which the ring of the socket ensures closing with the closing finger.

10. The device as set forth in claim 3, wherein the retaining element is a retaining keeper.

* * * * *